US006739223B2

(12) United States Patent
Wu

(10) Patent No.: US 6,739,223 B2
(45) Date of Patent: May 25, 2004

(54) ROLLER TYPE REVERSIBLE ADJUSTABLE WRENCH

(76) Inventor: Arthur Wu, No. 22, Alley 28, Lane 360, Chung Shan Rd., She Kou Village, Shen Kang Hsiang, Taichung Hsien (TW)

( * ) Notice: Subject to any disclaimer, the term of this patent is extended or adjusted under 35 U.S.C. 154(b) by 45 days.

(21) Appl. No.: 10/107,166

(22) Filed: Mar. 28, 2002

(65) Prior Publication Data

US 2003/0183047 A1 Oct. 2, 2003

(51) Int. Cl.[7] ..... B25B 13/12
(52) U.S. Cl. ..... 81/179; 81/165; 81/170
(58) Field of Search ..... 81/59.1, 165, 170, 81/179, 185.2

(56) References Cited

U.S. PATENT DOCUMENTS 720,784 A * 2/1903 Cochran ..... 81/170
2,646,711 A * 7/1953 Yavner ..... 81/179
2,721,493 A * 10/1955 Bergland ..... 81/179
2,730,000 A * 1/1956 Crittenden ..... 81/179
2,896,488 A * 7/1959 Ahana ..... 81/59.1
3,906,822 A * 9/1975 Hertelendy et al. ..... 81/179
4,158,975 A * 6/1979 DeSousa ..... 81/179
4,574,665 A * 3/1986 Blachly ..... 81/59.1
5,669,272 A * 9/1997 Hansen ..... 81/179
6,079,300 A * 6/2000 Hu ..... 81/165

* cited by examiner

*Primary Examiner*—James G. Smith
(74) *Attorney, Agent, or Firm*—Browdy and Neimark, P.L.L.C.

(57) ABSTRACT

A reversible adjustable wrench comprises a handle, which has a fixed jaw and a guiding groove at an end thereof. The fixed jaw has a gap and two cover pieces secured at lateral sides of the fixed jaw to form a chamber having an opening. The chamber has a guiding face therein, which has a stop portion at an end thereof closing to the tip end of the fixed jaw. A movable jaw has an end thereof slidable received in the guiding groove of the handle. An adjusting worm is pivoted at the handle for driving the movable jaw moving toward and away from the fixed jaw. A roller is received in the chamber of the fixed jaw, which has a part thereof exposed out of the chamber via the opening and is against the guiding face at opposite side, and two elastic members are received in recesses on the interior side of the cover pieces having an end thereof being against the fixed jaw and the other end thereof being against the roller for providing the roller a force substantially orientating to the tip end of the fixed jaw, whereby the roller will be stopped by the stop portion and only be driven to move along the guiding face.

15 Claims, 7 Drawing Sheets

ROLLER TYPE REVERSIBLE ADJUSTABLE WRENCH

FIELD OF THE INVENTION

The present invention relates to a wrench, and more particularly to a roller type reversible adjustable wrench.

BACKGROUND OF THE INVENTION

In prior art, when using an adjustable wrench to turn a nut (or a bolt), it has to disengage the nut after turning an angle. And then, turns the adjustable wrench reversibly and engages the adjustable wrench to the nut again for driving the nut to turn. User has to repeat the procedures described above to turn tight or to turn loose the nut.

FIG. 1 shows a conventional reversible adjustable wrench 90, which is capable of turning a nut without having to disengage and reengage the nut. The adjustable wrench 90 disposes two round channels 911 and 921 at the fixed jaw 91 and the movable jaw 92 respectively. Two racket rods 93 and 94, which have teeth faces 931 and 941 on outer ends thereof, are slidable received in the round channels 911 and 921 respectively. Two elastic members 95 and 96 are disposed at the fixed jaw 91 and the movable jaw 92 respectively for pushing the racket rods 93 and 94 respectively.

In use, user drives the movable jaw 92 moving toward the fixed jaw 91 to make the teeth faces 931 and 941 of the fixed jaw 91 and the movable jaw 92 holding a nut N. After that, user can turn the adjustable wrench 90 clockwise to drive the nut N to turn. On the contrary, when user turns the adjustable wrench 90 counterclockwise, the nut N will drive the racket rods 93 and 94 sliding into the round channels 911 and 921, such that the adjustable wrench 90 can turn backward but without driving the nut N to turn. Thus, the adjustable wrench 90 can turn a nut or a bolt without having to disengage and reengage the nut or the bolt repeatedly.

Hereunder are the disadvantages of the conventional reversible adjustable wrench 90 as described above:

1. The adjustable wrench 90 defines the teeth faces 931 and 941 of the racket rods 93 and 94 to hold the edges of the nut N. It will easy to damage the nut N when turning.
2. The adjustable wrench 90 is to turn the nuts in a range of different dimensions. There will be nuts of specific dimensions cannot be held by the teeth faces 931 and 941 stably.
3. If user drives the movable jaw 92 too close to the fixed jaw 91, the racket rods 93 and 94 will be pushed into the round channels 911 and 921 to cause the fixed jaw 91 and the movable jaw 92 will be against the nut N directly. Thus, the adjustable wrench 90 will loose the capability of repeated turning the nut.
4. The reversible adjustable wrench 90 is to hold the nut N by the teeth faces 931 and 941 of the racket rods 93 and 94 respectively, the nut N is suspended and not parallel to the fixed jaw 91 and the movable jaw 92. But the normal adjustable wrench is to hold the nut by fixed jaw and the movable jaw directly, where the nut is supported by the handle and is parallel to the fixed jaw and the movable jaw. The reversible adjustable wrench 90 had an operating mode different from conventional adjustable wrench that will make user can not get used to it rapidly.

SUMMARY OF THE INVENTION

The primary object of the present invention is to provide a reversible adjustable wrench, which has the capability of reversible turning a nut or a bolt but without the drawbacks as described above.

According to the objective of the present invention, a reversible adjustable wrench comprises a handle, which has a fixed jaw and a guiding groove at an end thereof. The fixed jaw has a chamber, which has an opening at a side of the fixed jaw. The chamber has a guiding face therein, which has a stop portion at an end thereof closing to the tip end of the fixed jaw. A movable jaw has an end thereof slidable received in the guiding groove of the handle. An adjusting worm is pivoted at the handle for driving the movable jaw moving toward and away from the fixed jaw. A roller is received in the chamber of the fixed jaw, which has a part thereof exposed out of the chamber via the opening and is against the guiding face at opposite side, and at least one elastic member is disposed between the fixed jaw and the roller for providing the roller a force substantially orientating to the tip end of the fixed jaw, whereby the roller will be stopped by the stop portion and only be driven to move along the guiding face.

DETAIL DESCRIPTION OF THE INVENTION

Figure 1:
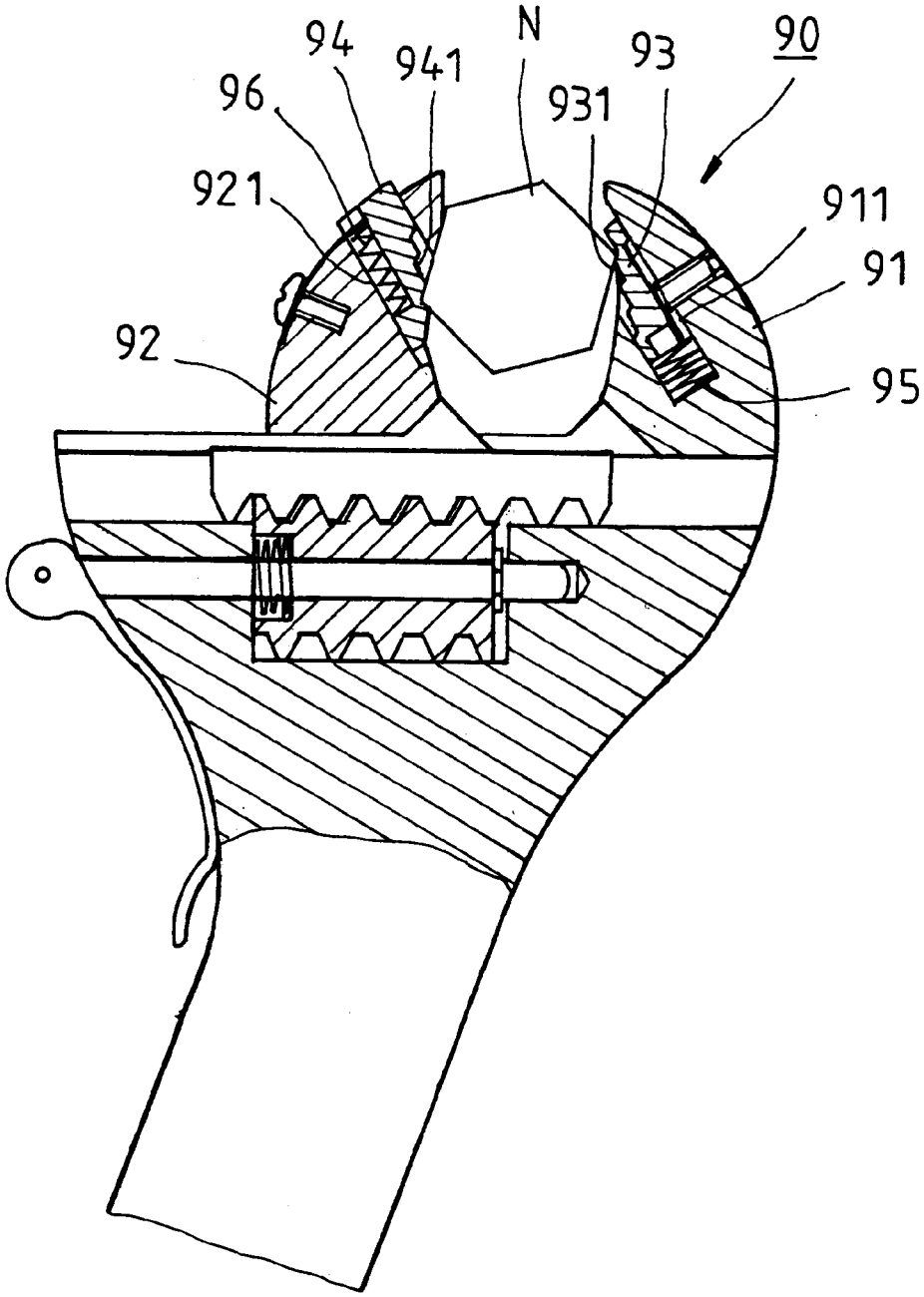
FIG.1 PRIOR ART
FIG. 1 is a section view of a prior art.
Figure 4:
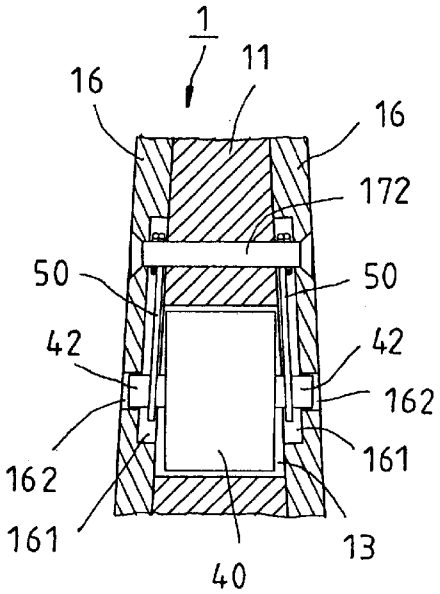
FIG. 4 is a sectional view along 4—4 line in FIG. 2.
Figure 2:
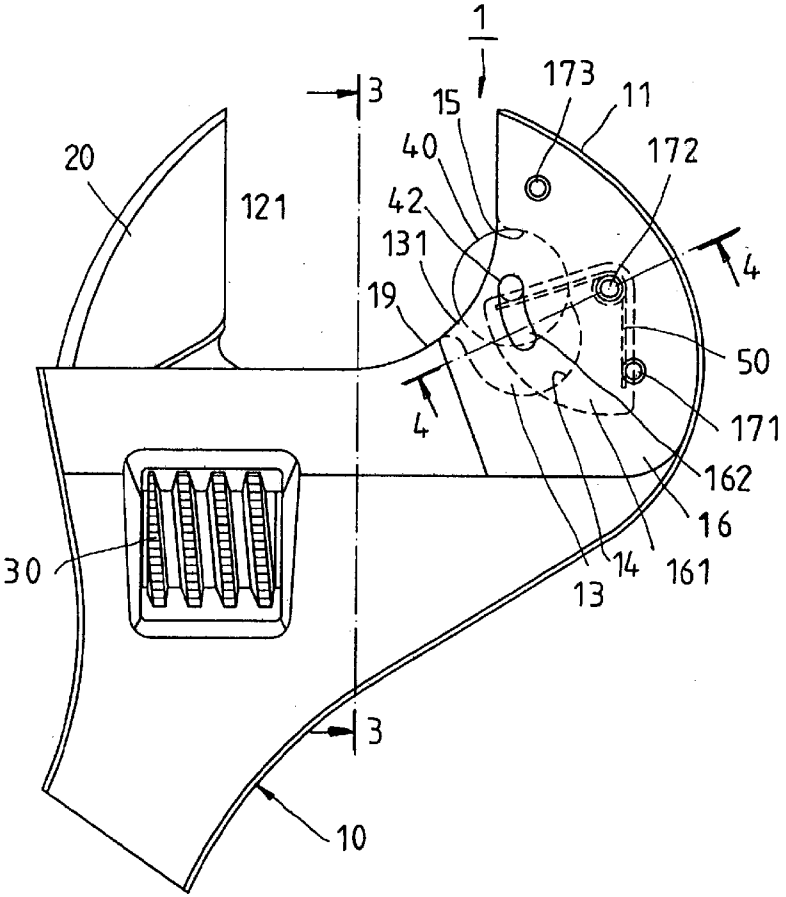
FIG. 2 is a front view of a first prefer embodiment of the present invention.
Figure 3:
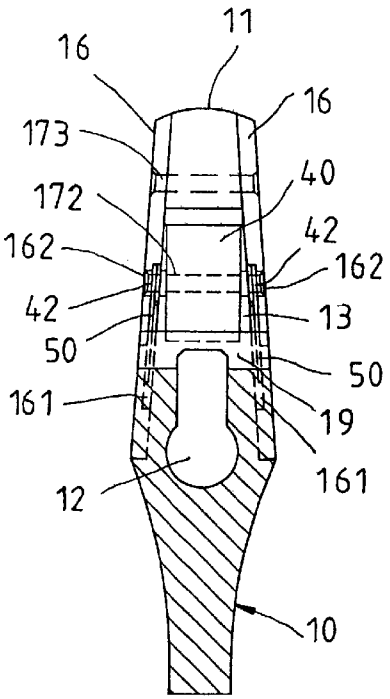
FIG. 3 is a sectional view along 3—3 line in FIG. 2.

Please refer to FIGS. from FIG. 2 to FIG. 4, the first prefer embodiment of the present invention provides a reversible adjustable wrench 1 comprises:

A handle 10 has a fixed jaw 11 at an end thereof and a guiding groove 12 beside the fixed jaw 11. The handle 10 defines two sliding faces 121 at topside of the guiding groove 12.

A movable jaw 20 has an end slidable received in the guiding groove 12 of the handle 10.

An adjusting worm 30 is pivoted on the handle 10 for driving the movable jaw 20 to slide toward or away from the fixed jaw 11.

The elements as described above are as same as the conventional adjustable wrench. The main characters of the present invention will be described hereunder.

Please refer to FIG. 2, the fixed jaw 11 has a gap 13, which is open at two lateral side thereof and the side facing to the movable jaw 12. The sidewall of the gap 13 is a continuous curved face, which defines a guiding face 14. The guiding face 14 has a stop portion 15, which is a substantial nest-like curved face, at the end thereof closing to the tip end of the fixed jaw 11. Two cover pieces 16 are secured on the fixed jaw 11 to cover the lateral openings of the gap 13 by means of three pins 171, 172 and 173. Thus, the gap will become a chamber 13, which only has an opening 131 facing to the movable jaw 12. Each cover piece 16 has a recess 161 at interior side thereof and a curved guiding slot 162 at the bottom side of the recess 161. The guiding slots 162 open at both sides of the cover piece 16 in the present embodiment.

The handle 10 further has an elevating track 19, which is a curved face extended from the sliding face 121 to the fixed jaw 11 closing to the opening 131 of the chamber 13. The movable jaw 20 has two recesses (not shown) at opposite sides respectively to avoid the movable jaw 20 interfering with the elevating track 19 while the movable jaw 20 is driven to move closed to the fixed jaw 11.

A roller 40 has two rods 42 at axle center thereof. The roller 40 is received in the chamber 13 of the fixed jaw 11 for the rods 42 thereof inserted into the guiding slots 162 respectively. Thus, the roller 40 has a part exploded out from the opening 131 of the chamber 13 and is against the guiding face 14 to be driven to move along the guiding face 14.

Two elastic members 50, which are torsional springs in the present invention, are received in the recesses 161 on the cover pieces 16 respectively. Each elastic member 50 has a portion at its center mounted on a pin 172 with an end thereof being engaged against the corresponding rod 42 of the roller 40 and the other end thereof being against the pin 171 for providing the roller 40 a force substantially orientating to the tip end of the fixed jaw 11. In the initial position, the elastic members 50 will push the roller 40 to make it to be against the stop portion 15 on the fixed jaw 11 to stop the roller 40. If there is an external force substantially orientating to the proximal end of the fixed jaw 11 exerting the roller 40, the roller 40 will be driven to move along the guiding face 14.

Figure 5:
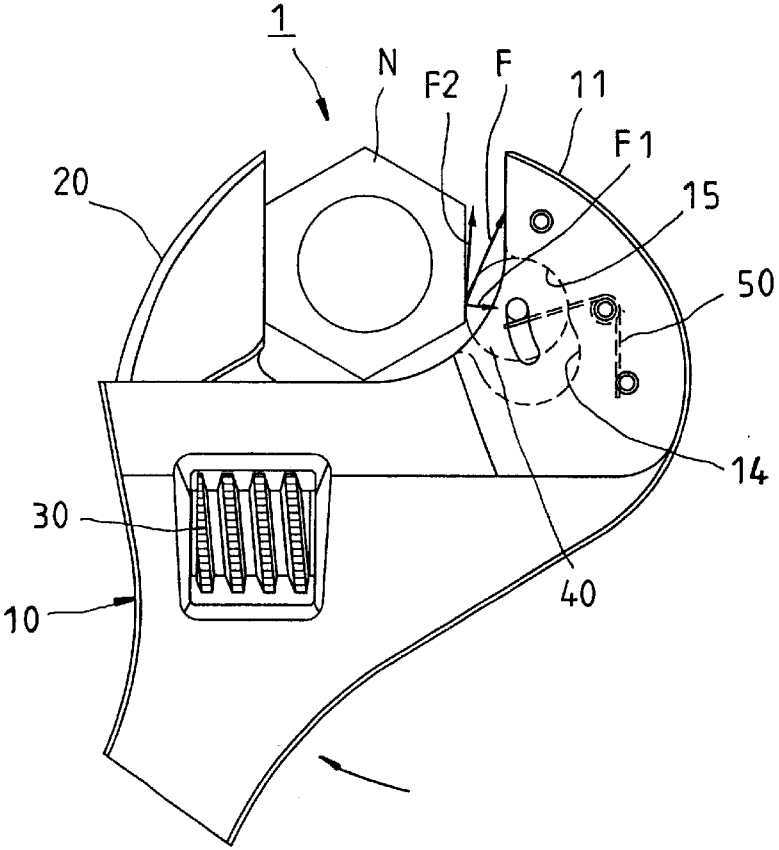
FIG. 5 is a front view of the first prefer embodiment of the present invention, showing the force exerted on the roller when turning the wrench.

FIG. 5 shows the reversible adjustable 1 wrench holding a nut N. In operating, user only needs to engage the wrench 1 with the nut N for the nut having an edge touching the sliding face 121 of the handle 10. Next, user can turn the adjusting worm 30 to drive the movable jaw 20 moving towards to the fixed jaw 11 to make the movable jaw 20 and the roller 40 against the opposite sides of the nut N respectively. The nut N will be set to be turned till the user can not turn the adjusting worm 30 anymore. So, the reversible adjustable wrench 1 of the present invention has a same operating mode as the conventional adjustable wrench.

Please refer to FIG. 5 again, if user tries to turn the adjustable wrench 1 to turn loose or turn tight the nut N, a force F will be exerted between the nut N and the roller 40. The counter force F can be resolved into two components F1 and F2. The component F1 will be opposed by the stop portion 15 of the fixed jaw 11 directly. The component F2 will produce a moment tending to drive the roller 40 to roll to the tip end of the fixed jaw 11. The moment will be opposed by the stop portion 15 too. So, the roller is fixedly kept in the stop portion 15 to drive the nut N to turn loose or to turn tight.

Figure 6:
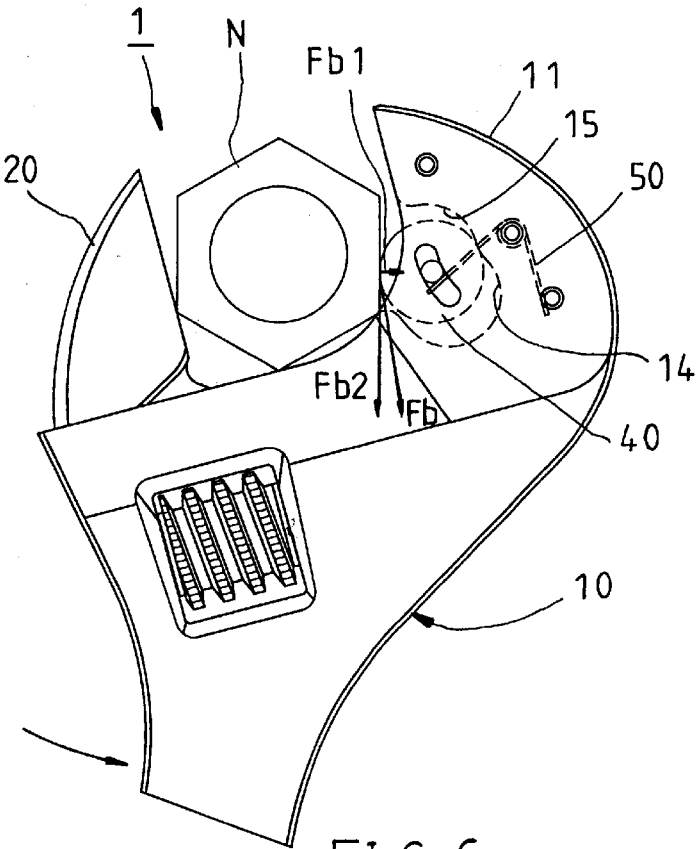
FIG. 6 is a front view of the first prefer embodiment of the present invention, showing the force exerted on the roller when turning the wrench reversibly.
Figure 7:
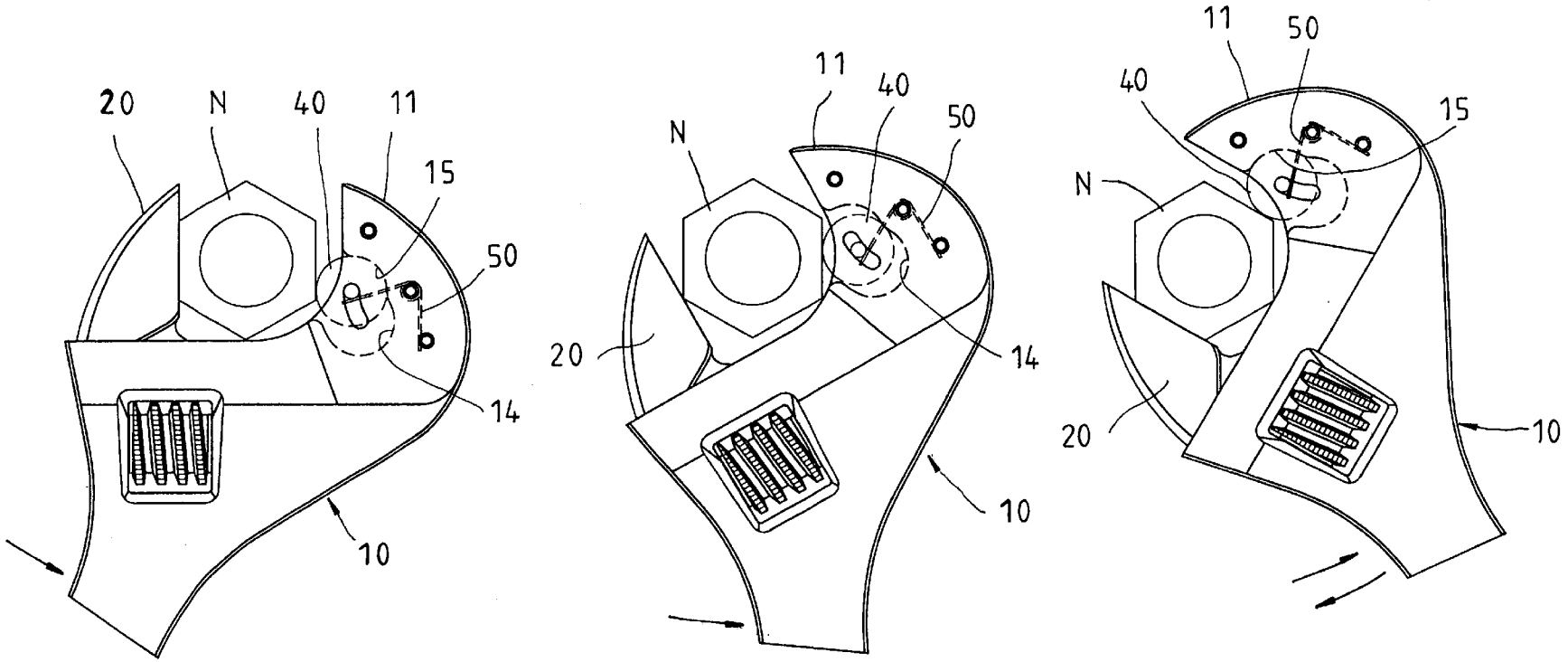
FIG. 7 shows the reversible adjustable wrench of the first prefer embodiment of the present invention turning reversibly, wherein FIG. 7*a* showing the wrench at initial position, FIG. 7*b* showing the wrench turning reversibly to 30 degrees and FIG. 7*c* showing the wrench turning reversibly to 60 degrees.

If the user tries to turn the adjustable wrench 1 of the present invention reversibly, please refer to FIG. 6, the roller 40 will receive a force Fb from the nut N. The force Fb can be resolved into two components F1 and F2 too. The component Fb1 will make the roller 40 being against the guiding face 40 at any moment of the wrench 1 being turned reversibly. The component Fb2 will produce a moment to drive the roller 40 to roll along the guiding face 14. Thus, the roller 40 will provide an essential space so that adjustable wrench 1 can be turned reversibly but keeping the nut N still. FIG. 7 shows the detail actions of the roller 40 relative to the nut N when the adjustable wrench 1 of the present invention is turned reversibly. When the adjustable wrench 1 had been turned reversibly 60 degrees, as shown in FIG. 7*c*, the movable jaw 20 and the roller 40 will hold the next sides of the nut N. The user can turn the wrench 1 again to drive the nut N to turn loose or to turn tight continuously without having to disengage the nut N at every turn.

Figure 8:
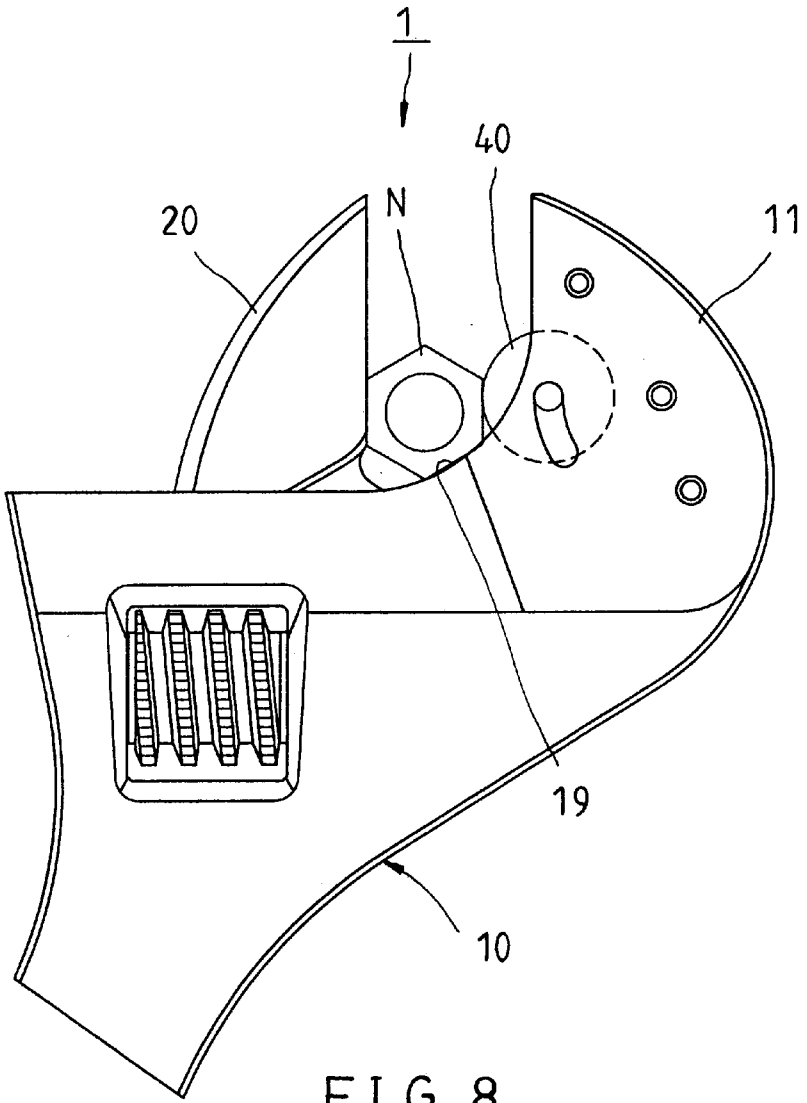
FIG. 8 is a front view of the first prefer embodiment of the present invention, showing the wrench being to turn a smaller nut.

Please refer to FIG. 8, when the adjustable wrench 1 of the present invention holds a smaller nut N, the nut N will stand on the elevating track 19 to be elevated a distance. Thus, the roller 40 and the movable jaw 20 will be against the opposite sides of the nut N respectively without having to take any step to adjust the position of the nut N. The operating mode of the adjustable wrench 1 of the present invention is as same as described above.

Figure 9:
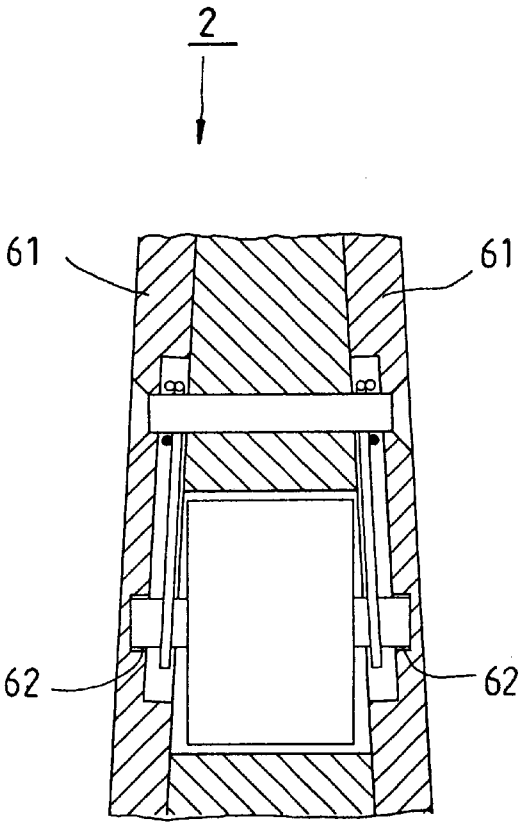
FIG. 9 is sectional view of a second prefer embodiment of the present invention.

Please refer to FIG. 9, the second prefer embodiment of the present invention provides a reversible adjustable wrench 2, which is similar to the first prefer embodiment, except that guiding slots 62 are closed at exterior side of cover pieces 61 respectively. That can prevent dusts or particles drop into the chamber via the guiding slots 62.

According to the description, you can find that the guiding face 14 and the stop portion 15 are the main elements to oppose the force produced in turning. In normal operating, the guiding slots 162 mainly are to stabilize the roller 40, not to oppose the force.

Figure 11:
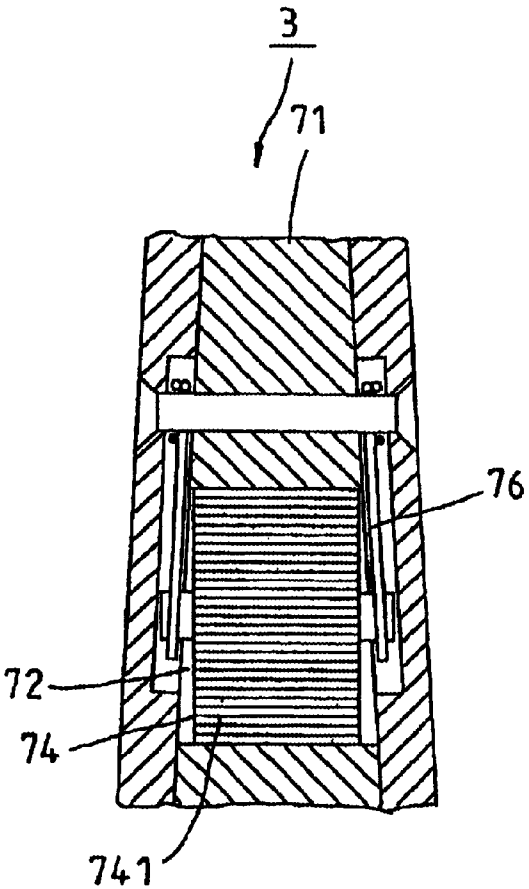
FIG. 11 is a sectional view along 11—11 line in FIG. 10.
Figure 10:
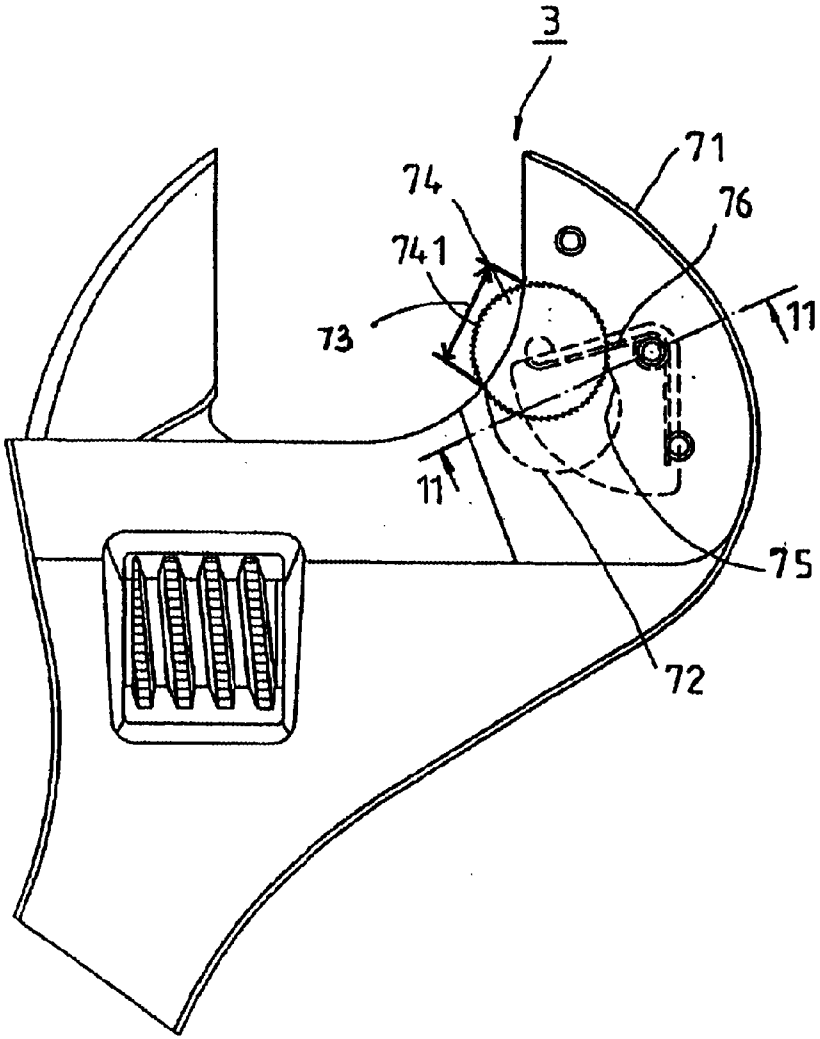
FIG. 10 is a front view of a third prefer embodiment of the present invention.
Figure 13:
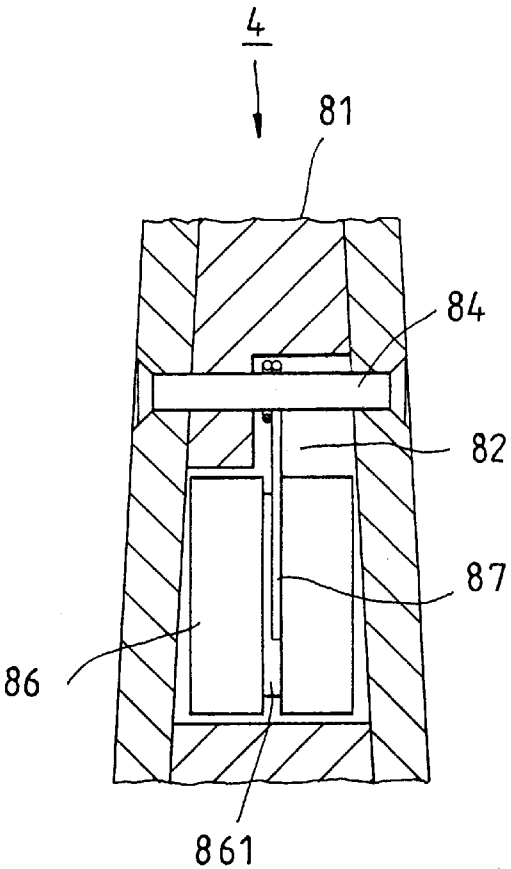
FIG. 13 is sectional view along 13—13 line in FIG. 12.

Thus, the third prefer embodiment of the present invention provides a reversible adjustable wrench 3, which provides no guiding slot. Please refer to FIG. 10 and FIG. 11, the width of the opening 73 of the chamber 72 on the fixed jaw 71 is smaller than the diameter of the roller 74. This precludes roller 74 from escaping from the chamber 72. The elastic members 76 have hook ends to hook the rods of the roller 74. The roller 74 further has a teeth portion 741 on the round surface. The teeth portion 741 has a ratchet shape to enhance the power of the roller 40 holding the nut when trying to drive the nut to turn but not affect turning reversibly.

Figure 12:
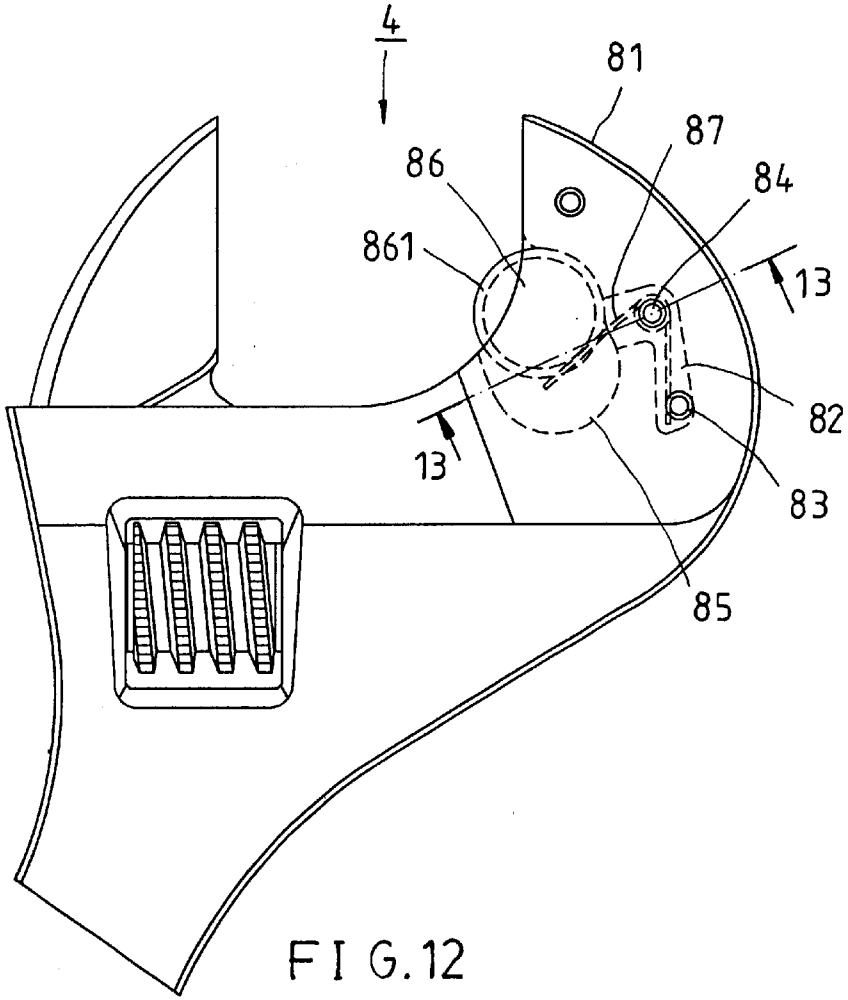
FIG. 12 is a sectional view of a fourth prefer embodiment of the present invention.

FIG. 12 shows a reversible adjustable wrench of the fourth prefer embodiment of the present invention, in which there is only one elastic member 87 is introduced in this prefer embodiment. The fixed jaw 81 has a groove 82 behind the chamber 85. The groove 82 has an end extending to the chamber 85. Two pins 83 and 84 for securing the cover pieces are located in the groove 82. The elastic member 87 is received in the groove 82 having the screw portion thereof mounted on the pin 84 and having an end against the pin 83. The roller 86 has a position groove 861 on the round surface for receiving the other end of the elastic member 87 therein. Thus, the elastic member 87 can provide the roller 86 an elastic force just as described above.

What is claimed is:

1. A reversible adjustable wrench, comprising:

a handle having a fixed jaw and a guiding groove at an end of said handle;

a movable jaw having an end thereof slidable received in said guiding groove of said handle;

an adjusting worm for driving said movable jaw moving toward and away from said fixed jaw;

wherein said fixed jaw has a chamber, which has an opening facing to said movable jaw and has at least one guiding slot on a lateral sidewall; said chamber having a guiding face therein, which has a stop portion at an end thereof toward the tip end of said fixed jaw;

a roller received in said chamber of said fixed jaw, which has a part thereof exposed out of said chamber through said opening; said roller having at least one rod thereon received in said guiding slot to permit said roller to engage against said guiding face, and at least one elastic member disposed between said fixed jaw and said roller for providing said roller a force substantially orientating to the tip end of said fixed jaw, wherein said roller will be stopped by said stop portion and is movable along said guiding face.

2. The adjustable wrench as defined in claim 1, wherein said fixed jaw has a gap thereon and two cover pieces respectively on lateral sides thereof covering said gap to form said chamber.

3. The adjustable wrench as defined in claim 2, wherein said guiding slot is disposed on each of said cover pieces.

4. The adjustable wrench as defined in claim 2, wherein each of said cover pieces have a recess at interior side for receiving said elastic member therein, said elastic member having an end engaged against said rod of said roller and the other end engaged against said fixed jaw.

5. The adjustable wrench as defined in claim 1, wherein said cover piece has a recess at interior side for receiving said elastic member therein, at least one pin is to secure said cover piece on said fixed jaw, said elastic member having an end engaged against said rod of said roller and the other end engaged against said pin.

6. The adjustable wrench as defined in claim 1, wherein said handle has an elevating track extending from a sliding face at the topside of said guiding groove to said fixed jaw.

7. The adjustable wrench as defined in claim 1, wherein said fixed jaw has a groove which has an end extending to said chamber for receiving said elastic member therein; said roller has a position groove thereon, whereby said elastic member has an end thereof engaged against said roller in said position groove and the other end thereof engaged against said fixed jaw in said groove.

8. The adjustable wrench as defined in claim 1, wherein said roller has a teeth portion thereon.

9. A reversible adjustable wrench, comprising:

a handle having a fixed jaw and a guiding groove at an end of said handle;

a movable jaw having an end thereof slidable received in said guiding groove of said handle;

an adjusting worm for driving said movable jaw moving toward and away from said fixed jaw;

wherein said fixed jaw a chamber, which has an opening facing to said movable jaw; said chamber having a guiding face therein, which has a stop portion at an end thereof toward the tip end of said fixed jaw;

a roller received in said chamber of said fixed jaw, which has a part thereof exposed out of said chamber through said opening and is against said guiding face, and at least one elastic member disposed between said fixed jaw and said roller for providing said roller a force substantially orientating to the tip end of said fixed jaw, wherein said roller will be stopped by said stop portion and is moveable along said guiding face.

10. The adjustable wrench as defined in claim 9, wherein said fixed jaw has a gap thereon and two cover pieces respectively engaged on lateral sides thereof covering said gap to form said chamber.

11. The adjustable wrench as defined in claim 10, wherein each of said cover pieces have a recess at interior side for receiving said elastic member therein, said roller has a rod thereon to which an end of said elastic member is engaged against.

12. The adjustable wrench as defined in claim 10, wherein each of said cover pieces have a recess at interior side for receiving said elastic member therein, at least one pin securing each of said cover pieces on said fixed jaw, said roller having a rod thereon, said elastic member having an end engaged against said rod of said roller and the other end being engaged against said pin.

13. The adjustable wrench as defined in claim 9, wherein said handle has an elevating track extending from a sliding face at the topside of said guiding groove to said fixed jaw.

14. The adjustable wrench as defined in claim 9, wherein said fixed jaw has a groove which has an end extending to said chamber for receiving said elastic member therein; said roller has a position groove thereon, whereby said elastic member has an end thereof engaged against said roller in said position groove and the other end thereof engaged against said fixed jaw in said groove.

15. The adjustable wrench as defined in claim 9, wherein said roller has a teeth portion thereon.

* * * * *